US005955229A

United States Patent [19]

Saita

[11] Patent Number: 5,955,229

[45] Date of Patent: Sep. 21, 1999

[54] ELECTROPHOTOGRAPHIC PHOTORECEPTOR

[75] Inventor: Atsuo Saita, Yokohama, Japan

[73] Assignee: Mitsubishi Chemical Corporation, Tokyo, Japan

[21] Appl. No.: 08/974,918

[22] Filed: Nov. 20, 1997

[30] Foreign Application Priority Data

Nov. 21, 1996 [JP] Japan ..... 8-310618

[51] Int. Cl.[6] ..... G03G 5/06

[52] U.S. Cl. ..... 430/59; 430/56

[58] Field of Search ..... 430/59, 56, 83

[56] References Cited

U.S. PATENT DOCUMENTS

| | | | |
|---|---|---|---|
| 4,859,556 | 8/1989 | Sasaki . | |
| 4,892,949 | 1/1990 | Sasaki . | |
| 4,900,645 | 2/1990 | Ueda . | |
| 5,338,633 | 8/1994 | Nozomi et al. | 430/59 |
| 5,413,887 | 5/1995 | Ueda . | |

FOREIGN PATENT DOCUMENTS

| | | | |
|---|---|---|---|
| 57-125941 | 8/1982 | Japan | 430/59 |
| 61-69070 | 4/1986 | Japan . | |
| 3-113459 | 5/1991 | Japan . | |

*Primary Examiner*—Christopher D. Rodee

*Attorney, Agent, or Firm*—Oblon, Spivak, McClelland, Maier & Neustadt, P.C.

[57] ABSTRACT

An electrophotographic photoreceptor having a photosensitive layer on a conductive substrate is provided, in which a stilbene compound represented by the formula [I] contained in the photosensitive layer to give the photoreceptor excellent sensitivity and residual potential.

[I]

6 Claims, 2 Drawing Sheets

ELECTROPHOTOGRAPHIC PHOTORECEPTOR

FIELD OF THE INVENTION

The present invention relates to an electrophotographic photoreceptor. More specifically, the present invention relates to an electrophotographic photoreceptor with high sensitivity and high performance having a photosensitive layer which contains organic photoconductive materials.

BACKGROUND OF THE INVENTION

Conventionally, inorganic photoconductive materials such as selenium, cadmium sulfide, or zinc oxide have been used widely for the photosensitive layer of the electrophotographic photoreceptor. However, these materials are disadvantageous in that: selenium and cadmium sulfide need to be recovered as toxic substances; that selenium has poor heat resistance because it crystallizes by heating; that cadmium sulfide and zinc oxide have poor moisture resistance; and that zinc oxide does not have printing durability. Thus, an attempt has been made continuously to develop new photoreceptors. Recently, researches on application of organic photoconductive materials to the photosensitive layer of the electrophotographic photoreceptor have been progressed and some of them have been put into practical use. Compared with inorganic photoconductive materials, organic photoconductive materials are advantageous in that: their weights are light; that they can be easily formed into film; that photoreceptors containing them can be easily produced; that some of them enable productions of transparent photoreceptors; and that raw materials are harmless.

Recently, development of the so-called function distribution type of the photoreceptors in which functions of generation and transfer of a charge carrier are distributed to different compounds, is recent main current, because this type is effective for high sensitivity. An attempt has been made to practically use this type of organic photoreceptors.

As a charge carrier-transferring medium, either a high molecular photoconductive materials such as polyvinyl carbazole or a low molecular photoconductive compound which is dissolved and dispersed in binder polymer, is used.

Particularly, photoreceptors excellent in mechanical properties can be easily produced by using organic low molecular photoconductive compounds, since it is possible to select polymer having excellent film-forming property, flexibility, and adhesive property (see, for example, Japanese Patent Laid-Open Publication No. 63-269160, Japanese Patent Publication Nos. 3-39306 and 4-53308, etc.). However, it is difficult to find materials suitable for producing highly sensitive photoreceptors.

SUMMARY OF THE INVENTION

The present inventors intensively investigated organic low molecular photoconductive materials which can achieve above objects and, as a result, it has been found that specific stilbene compounds can suitably be used. Thus, the present invention has been made based on this finding. That is, the gist of the present invention resides in an electrophotographic photoreceptor having a photosensitive layer on a conductive substrate, wherein said photosensitive layer comprises a stilbene compound represented by the formula [I]:

[I]

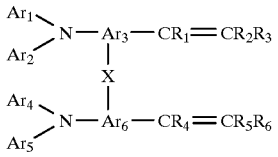

wherein $Ar_1$, $Ar_2$, $Ar_4$, and $Ar_5$ each represent a substituted or unsubstituted alkyl group, a substituted or unsubstituted aryl group, a substituted or unsubstituted aralkyl group, a substituted or unsubstituted heterocyclic group, or a substituted or unsubstituted condensed polycyclic group, and these may be the same or different;

$Ar_3$ and $Ar_6$ each represent a substituted or unsubstituted a trivalent aromatic hydrocarbon ring group, a substituted or unsubstituted trivalent heterocyclic group, a substituted or unsubstituted trivalent condensed polycyclic group, or a substituted or unsubstituted trivalent biphenyl group, and these may be the same or different;

$R_1$, $R_2$, $R_3$, $R_4$, $R_5$, and $R_6$ each represent a hydrogen atom, a substituted or unsubstituted alkyl group, a substituted or unsubstituted aralkyl group, a substituted or unsubstituted aryl group, a substituted or unsubstituted heterocyclic group, or a substituted or unsubstituted condensed polycyclic group, and these may be the same or different, provided that when one of a couple of $R_2$ and $R_3$ and a couple of $R_5$, and $R_6$ represents a hydrogen atom, a substituted or unsubstituted alkyl group, or a substituted or unsubstituted aralkyl group, the other represents a substituted or unsubstituted aryl group, a substituted or unsubstituted heterocyclic group, or a substituted or unsubstituted condensed polycyclic group, provided that the substituent of $R_2$, $R_3$, $R_5$and $R_6$ is not a di-substituted amino group; and X represents a substituted or unsubstituted alkenylene group, a substituted or unsubstituted arylene group, or a substituted or unsubstituted divalent heterocyclic group, or a group represented by any of the formulae [II] to [V]:

[II]

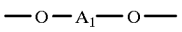

[III]

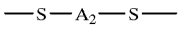

[IV]

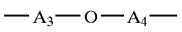

[V]

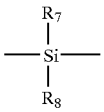

wherein $A_1$, $A_2$, $A_3$, and $A_4$ each represent a substituted or unsubstituted alkylene group, a substituted or unsubstituted alkenylene group, or the formula [V], wherein $R_7$ and $R_8$ each represent a substituted or unsubstituted alkyl group, a substituted or unsubstituted aralkyl group, a substituted or unsubstituted aryl group, a substituted or unsubstituted heterocyclic group, a substituted or unsubstituted condensed polycyclic group, and these may be the same or different, or $R_7$ and $R_8$ may combine to form a substituted or unsubstituted cycroalkyl group; $Ar_1$ and $Ar_2$, $Ar_2$ and $Ar_3$, $Ar_1$ and $Ar_3$, $Ar_4$ and $Ar_5$, $Ar_5$ and $Ar_6$, $Ar_4$ and $Ar_6$, $R_2$ and $R_3$, and $R_5$ and $R_6$ may link directly or via a binding group.

DETAILED DESCRIPTION OF THE INVENTION

Figure 1:
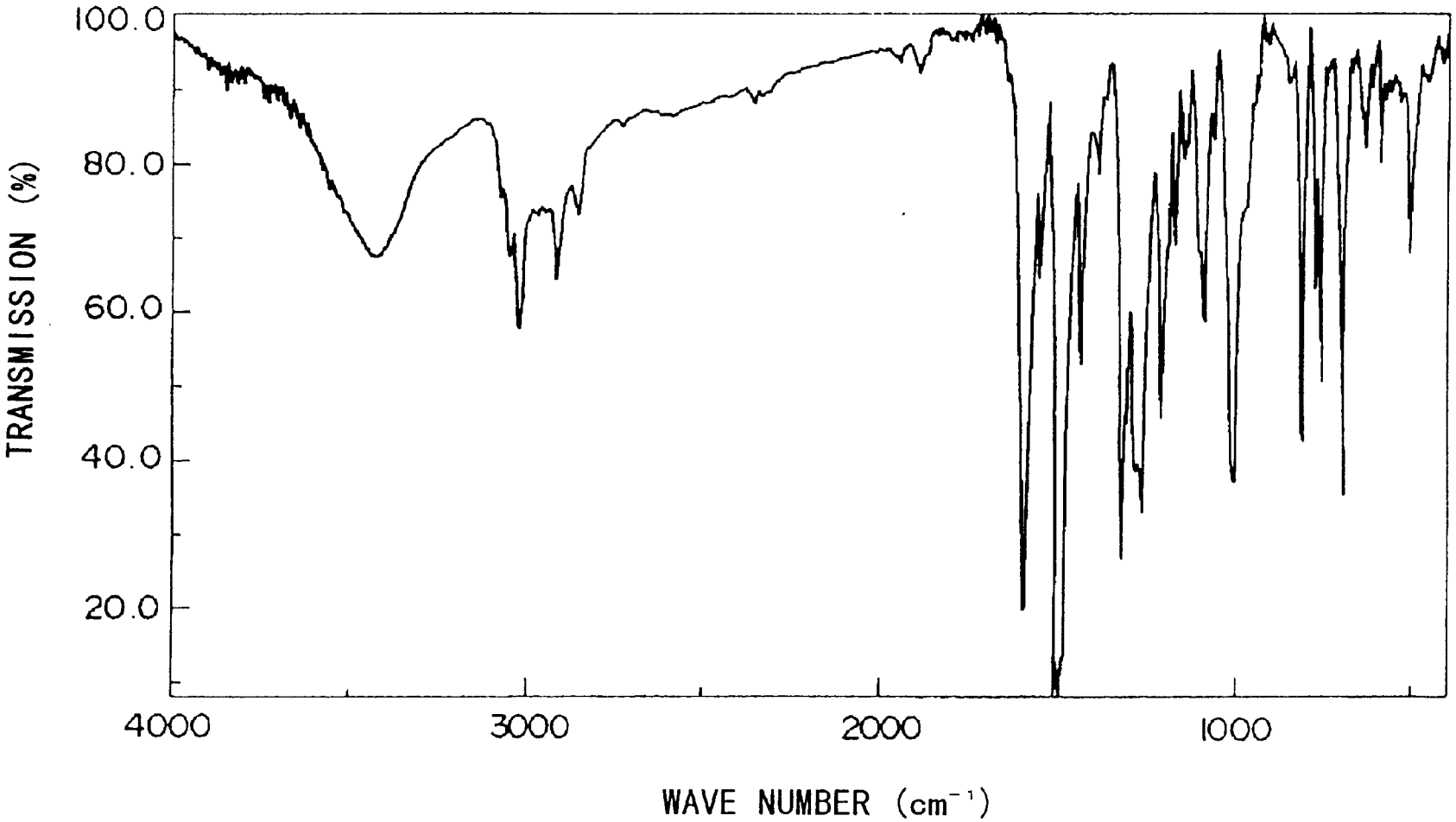
FIG. 1 shows infrared absorption spectrum of the stilbene compound produced in Production Example 1.

The present invention will be described in detail below.

The electrophotographic photoreceptor according to the present invention contains a stilbene compound represented by the above formula [I] in the photosensitive layer.

In the above formula [I], $Ar_1$, $Ar_2$, $Ar_4$, and $Ar_5$ each represent an alkyl group such as a methyl group, an ethyl group, a propyl group, a butyl group, or a hexyl group; an aryl group such as a phenyl group or a naphthyl group; an aralkyl group such as a benzyl group, a naphthylmethyl group, or a phenethyl group; a heterocyclic group such as a thienyl group, a furyl group, or a pyridyl group; a condensed polycyclic group such as a pyrenyl group, an anthracenyl group, or a fluorenyl group. An aryl group and a condensed polycyclic group are particularly preferred, and these may be the same or different. These alkyl, aryl, aralkyl, heterocyclic, and condensed polycyclic groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

$Ar_3$ and $Ar_6$ each represent a trivalent aromatic hydrocarbon ring group derived from benzene, naphthalene, and the like; a trivalent heterocyclic group derived from thiophene, furan, pyridine, and the like; a trivalent condensed polycyclic group derived from pyrene, anthracene, fluorene, and the like; or a trivalent biphenyl group. Particularly preferred are a trivalent aromatic hydrocarbon ring group, a trivalent condensed polycyclic group, and a trivalent biphenyl group, which may be the same or different. These trivalent aromatic hydrocarbon ring, trivalent heterocyclic, trivalent condensed polycyclic, and trivalent biphenyl ring groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

$R_1$ and $R_4$ each represent a hydrogen atom; an alkyl group such as a methyl group, an ethyl group, a propyl group, a butyl group, or a hexyl group; an aryl group such as a phenyl group or a naphthyl group; an aralkyl group such as a benzyl group, a naphthylmethyl group, or a phenethyl group; a heterocyclic group such as a thienyl group, a furyl group, or a pyridyl group; a condensed polycyclic group such as a pyrenyl group, an anthracenyl group, or a fluorenyl group. These may be the same or different. These alkyl, aryl, aralkyl, heterocyclic, and condensed polycyclic groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

$R_2$, $R_3$, $R_5$, and $R_6$ each represent a hydrogen atom; an alkyl group such as a methyl group, an ethyl group, a propyl group, a butyl group, or a hexyl group; an aryl group such as a phenyl group or a naphthyl group; an aralkyl group such as a benzyl group, a naphthylmethyl group, or a phenethyl group; a heterocyclic group such as a thienyl group, a furyl group, or a pyridyl group; a condensed polycyclic group such as a pyrenyl group, an anthracenyl group, or a fluorenyl group. These may be the same or different. These alkyl, aryl, aralkyl, heterocyclic, and condensed polycyclic groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a nitro group; an acyl group such as an acetyl group or a benzoyl group; and the like, provided that when one of a couple of $R_2$ and $R_3$ and a couple of $R_5$ and $R_6$ represents a hydrogen atom, a substituted or unsubstituted alkyl group, or a substituted or unsubstituted aralkyl group, the other represents a substituted or unsubstituted aryl group, a substituted or unsubstituted heterocyclic group, or a substituted or unsubstituted condensed polycyclic group.

X represents an alkenylene group such as a vinylene group, a propenylene group, or a butenylene group; an arylene group such as a phenylene group, a biphenylene group, or a naphthalene group; a divalent heterocyclic group such as a thienylene group or a furylene group; or a group represented by any of the formulae [II] to [V].

[II]

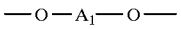

[III]

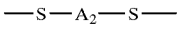

[IV]

[V]

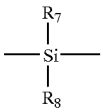

In the formulae [II], [III], and [IV], $A_1$, $A_2$, $A_3$, and $A_4$ each represent an alkylene group such as a methylene group, an ethylene group, or a propylene group; or an alkenylene group such as a vinylene group, a propenylene group, or a butenylene group. These alkylene and alkenylene groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

In the formula [V], $R_7$ and $R_8$ each represent an alkyl group such as a methyl group, an ethyl group, a propyl group, a butyl group, or a hexyl group; an aralkyl group such as a benzyl group, a naphthylmethyl group, or phenethyl group; an aryl group such as a phenyl group or a naphthyl group; a heterocyclic group such as a thienyl group, a furyl group, or a pyridyl group; a condensed polycyclic group such as a pyrenyl group, an anthracenyl group, or a fluorenyl group. These may be the same or different and $R_7$ and $R_8$ may combine to represent a cycloalkyl group such as a cyclohexyl group. These alkyl, aralkyl, aryl, heterocyclic, condensed polycyclic, and cycloalkyl groups may be substituted. Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an allyloxy group; an aralkyl group such as a benzyl group, a naphthylmethyl group, or a phenethyl group; an aryloxy group such as a phenoxy group or a tolyloxy group; an aralkyloxy group such as a benzyloxy group, a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

In the formula [I], $Ar_1$ and $Ar_2$, and $Ar_4$ and $Ar_6$ may link directly or via a binding group. They may have, for example, the structure represented by the following formulae [VI], [VII], [VIII], [IX], or [X]:

[VI]

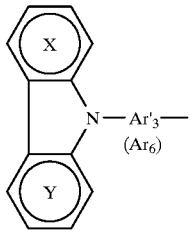

[VII]

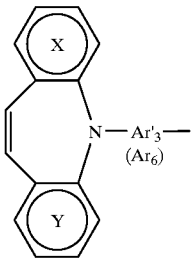

-continued
[VIII]
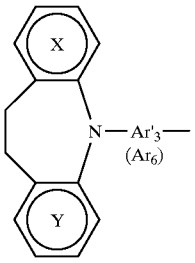
[IX]
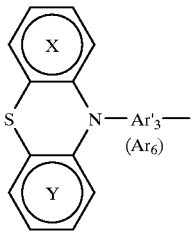
[X]
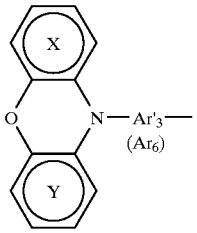
In the formula [I], $Ar_1$, and $Ar_3$, and $Ar_2$ and $Ar_3$, $Ar_4$ and $Ar_6$, and $Ar_5$ and $Ar_6$ may link directly or via a binding group and may have the structure represented by the following formulae [XI], [XII], [XIII], [XIV], [XV], [XI'], [XII'], [XIII'], [XIV'], OR [XV']:
[XI]
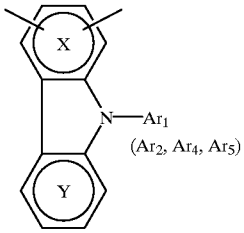
[XII]
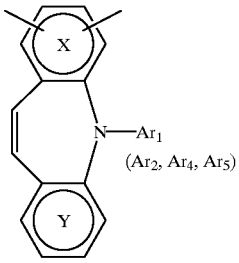
-continued
[XIII]
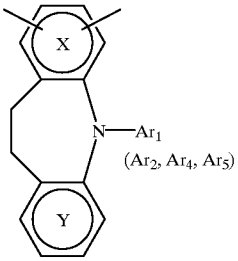
[XIV]
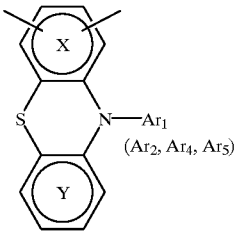
[XV]
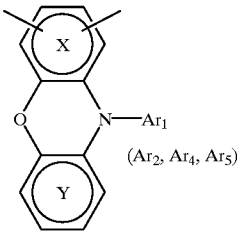
[XI']
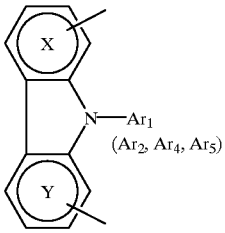
[XII']
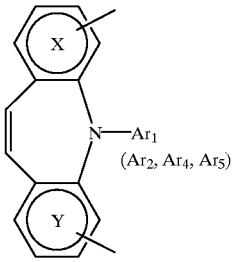
[XIII']
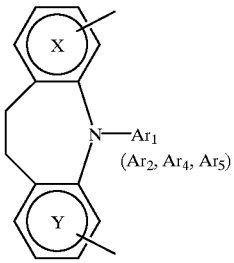

-continued

[XIV']

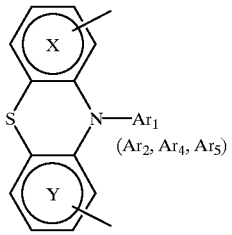

[XV']

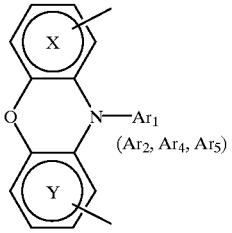

In the formula [I], $R_2$ and $R_3$, and $R_5$ and $R_6$ may link directly or via a binding group, and may have structure represented by the following formulae [XVI], [XVII], [XVIII], [XIV], [XV], [XVI], [XVII], [XVIII], OR [XIX]:

[XVI]

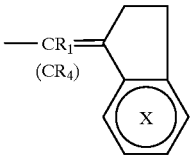

[XVII]

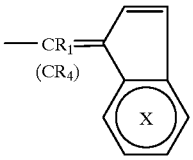

[XVIII]

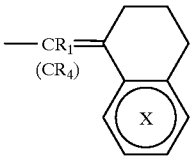

[XIV]

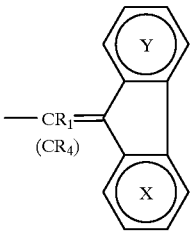

-continued

[XV]

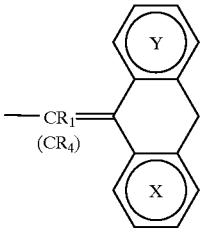

[XVI]

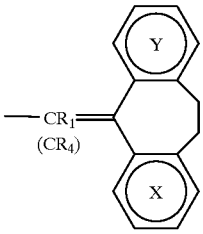

[XVII]

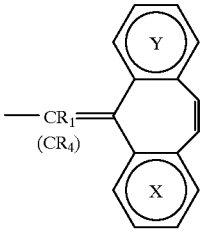

[XVIII]

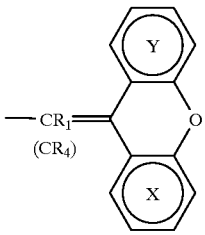

[XIX]

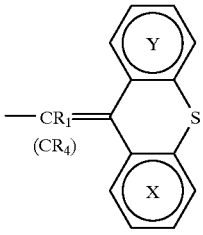

In the formulae [VI] to [XIX], X and Y represent a benzene ring which may have one or more substituent(s). Examples of the substituents include a hydroxyl group; a halogen atom such as a chlorine atom, a bromine atom, or an iodine atom; an alkyl group such as a methyl group, an ethyl group, a propyl group, a butyl group, or a hexyl group; an alkoxy group such as a methoxy group, an ethoxy group, or a butoxy group; an allyl group; an aralkyl group such as a benzyl group, a naphthylmethyl group, or a phenethyl group; an aryloxy group such as a phenoxy group or a tolyloxy group; an aralkyloxy group such as a benzyloxy group or a phenethyloxy group; an aryl group such as a phenyl group or a naphthyl group; a heterocyclic group such as a thienyl group or a furyl group; an arylvinyl group such as a styryl group or a naphthylvinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dithienylamino group or a difurylamino group; a diallylamino group; a di-substituted amino group which is the combination of the above amino groups; a nitro group; an acyl group such as an acetyl group or a benzoyl group; and the like.

Typical examples of the stilbene compounds represented by the formula [I] will be described below, but these examples are illustrative, and are not to be construed to limit the stilbene compounds used in the present invention.

Demonstrative Compound Nos:

1

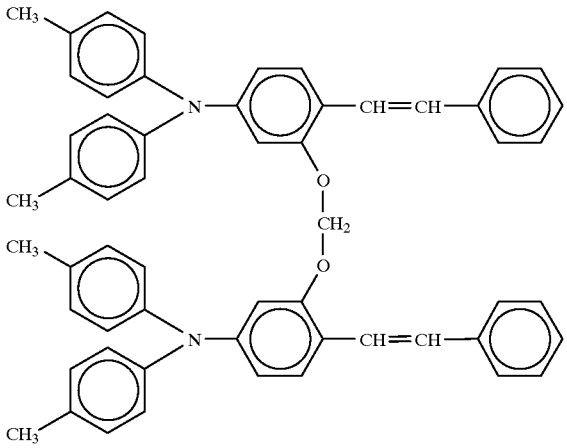

2

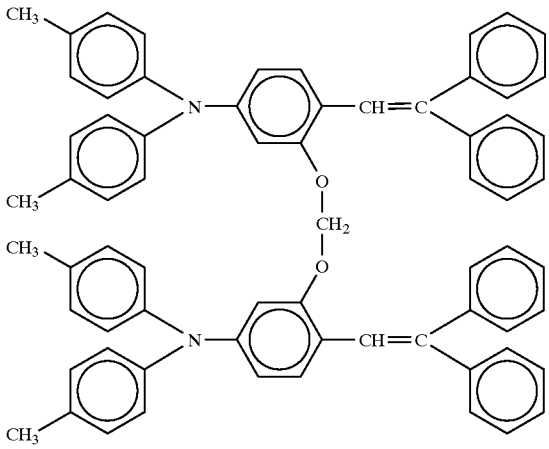

3

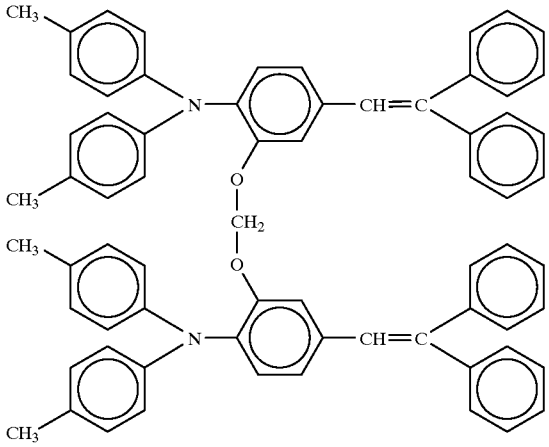

-continued
4
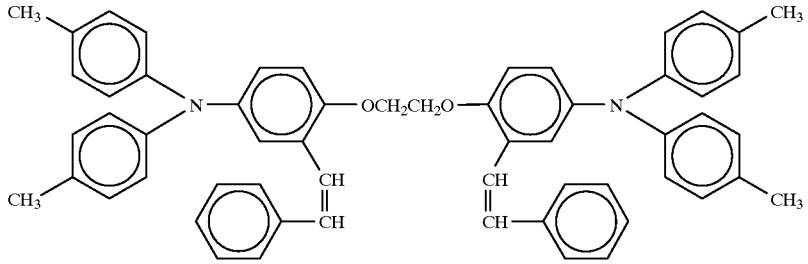
5
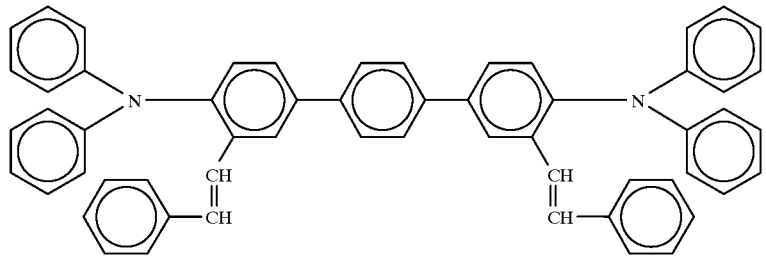
6
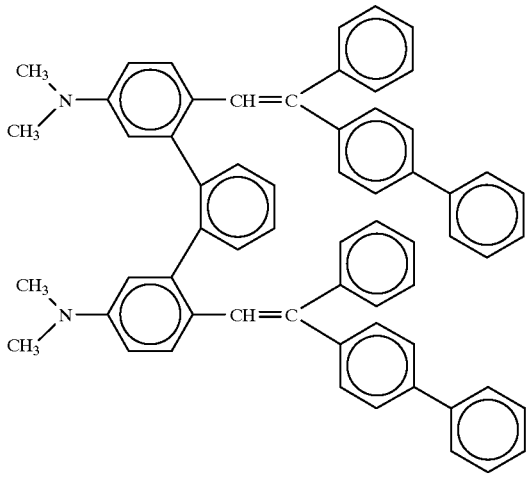
7
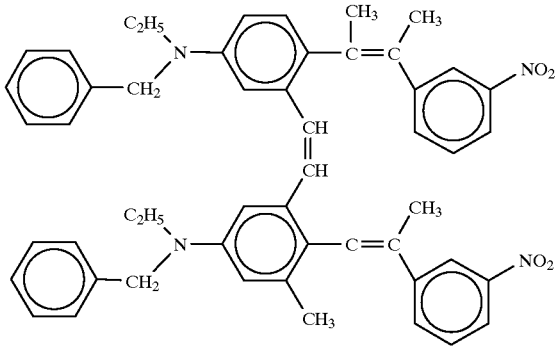

-continued
8
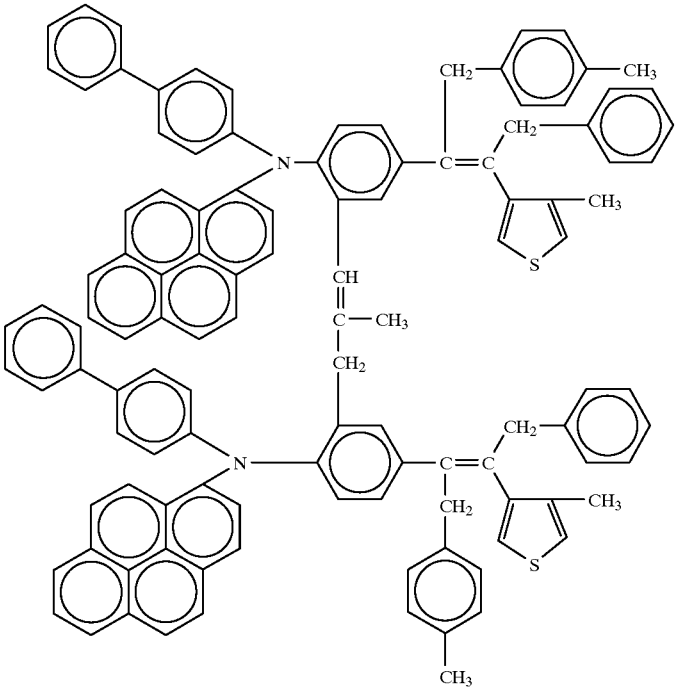
9
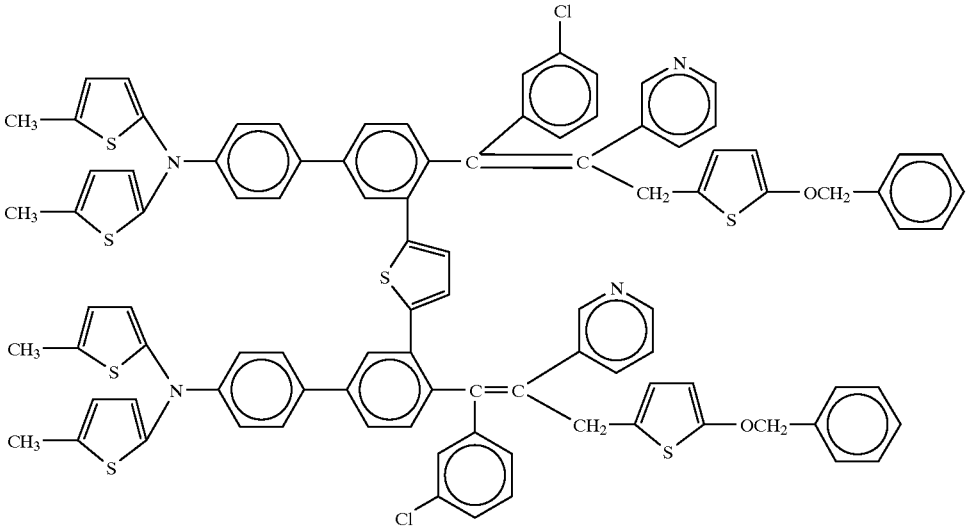

-continued
10
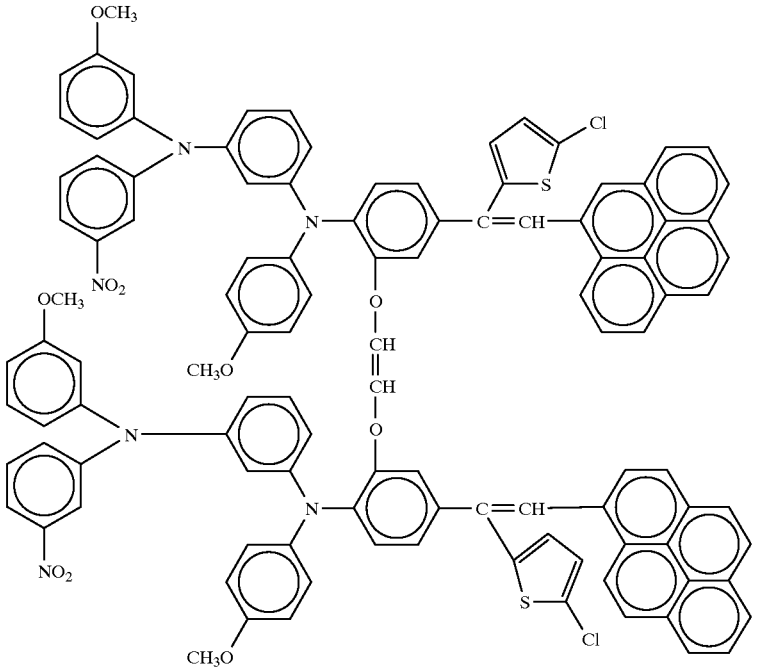
11
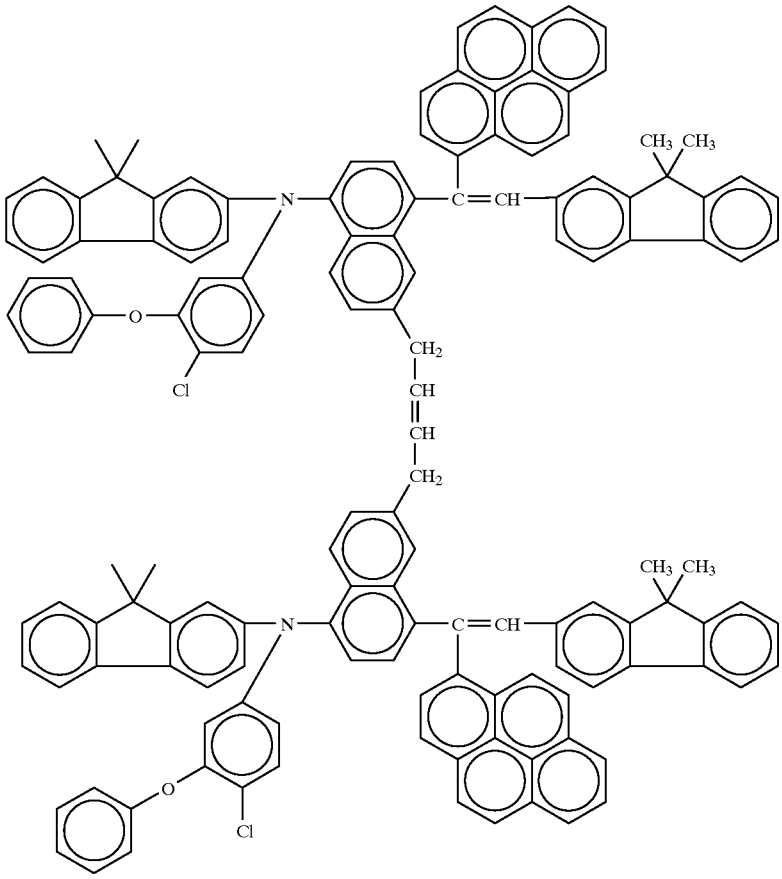

-continued
12
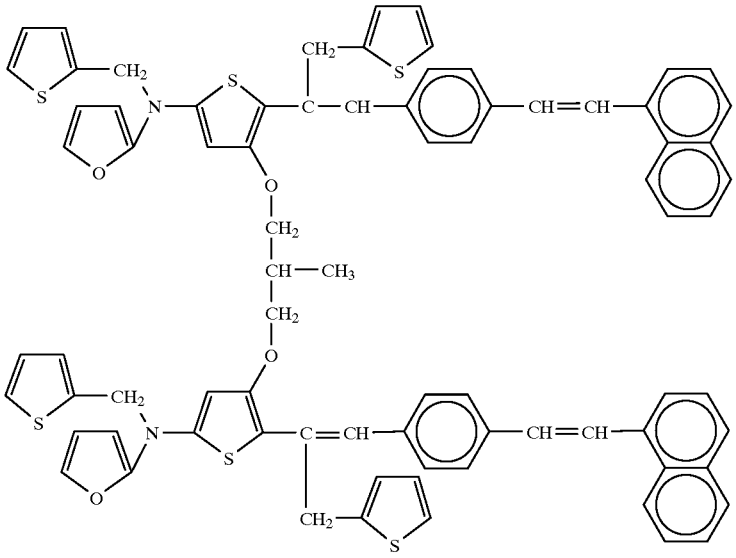
13
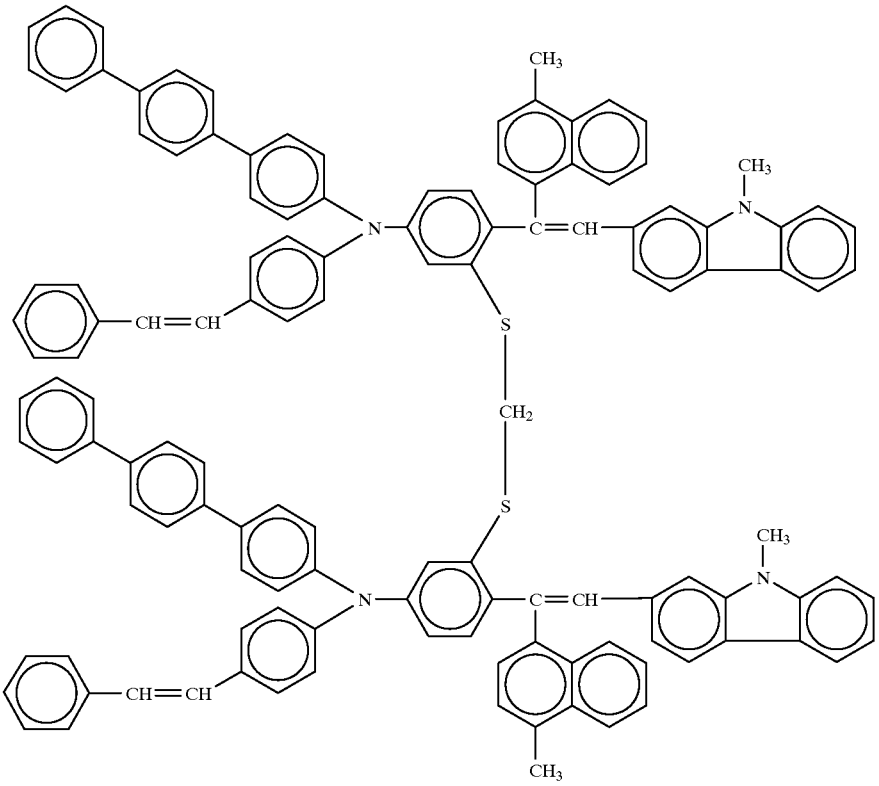

-continued
14
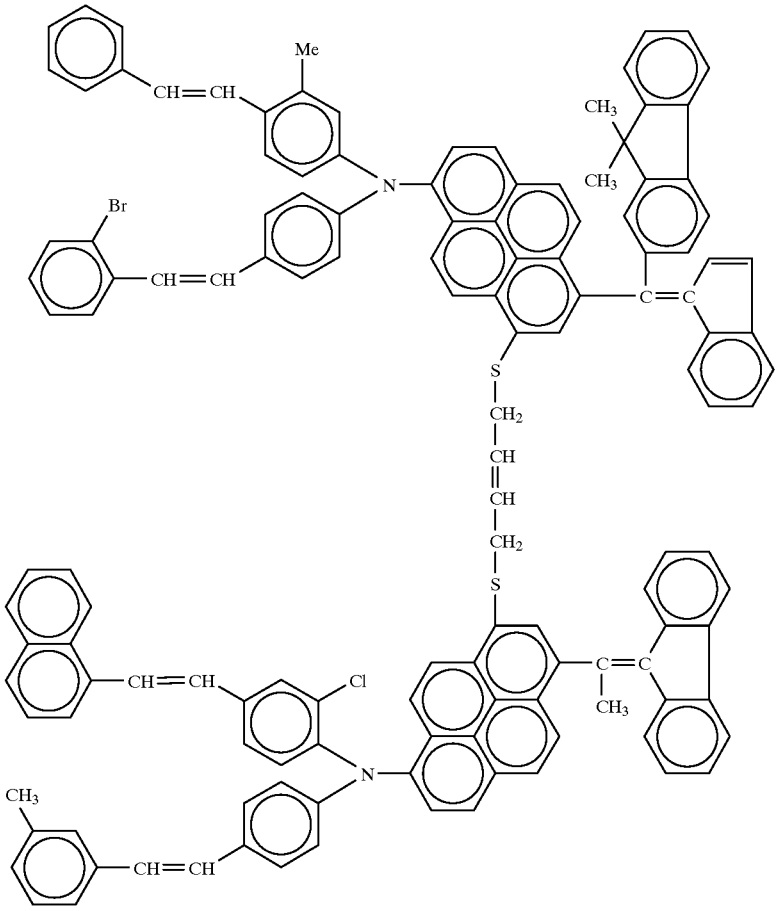
15
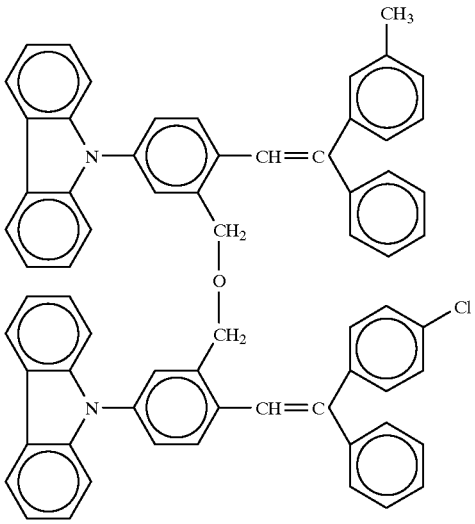

-continued
16
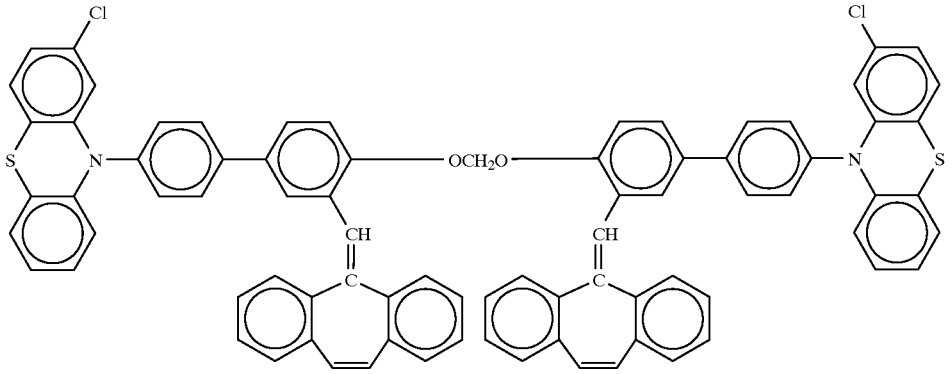
17
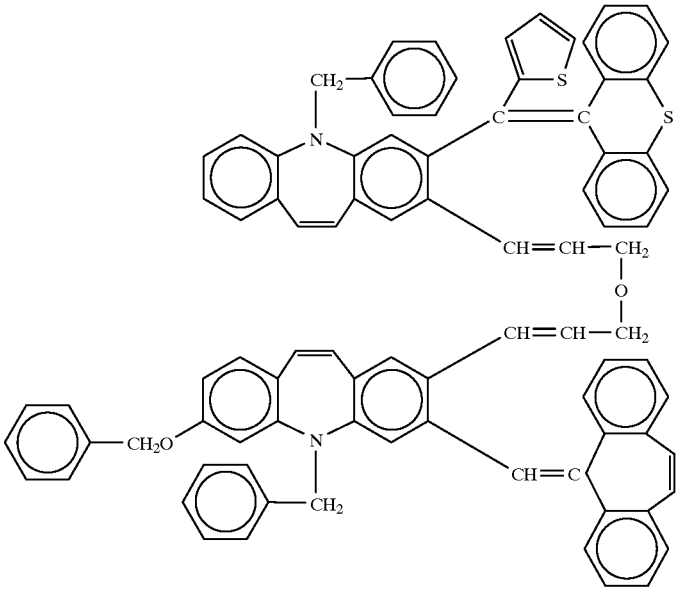
18
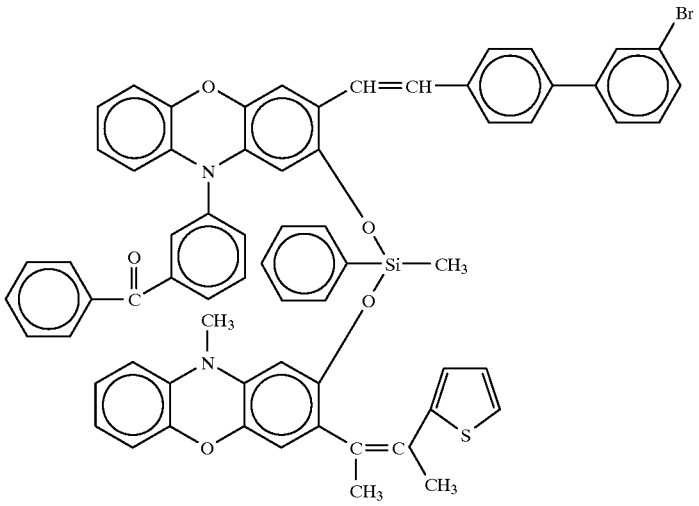

-continued
19
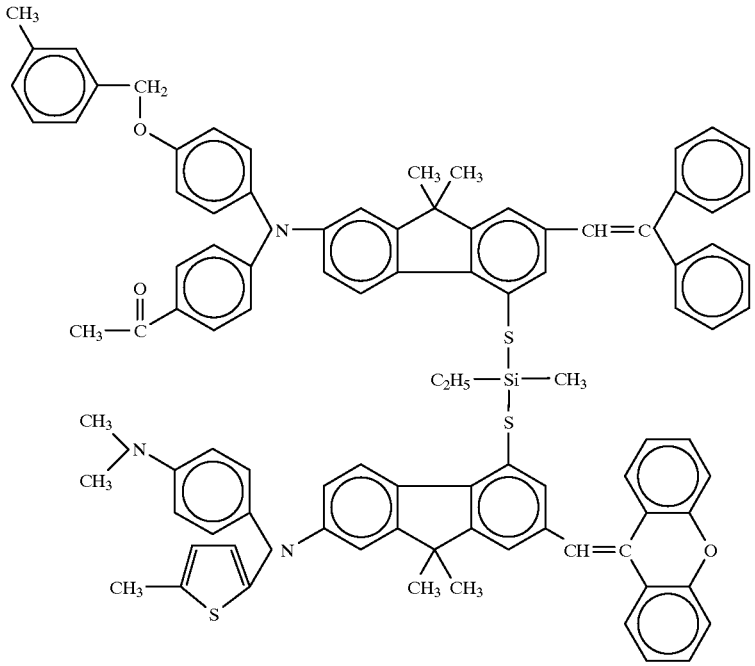
20
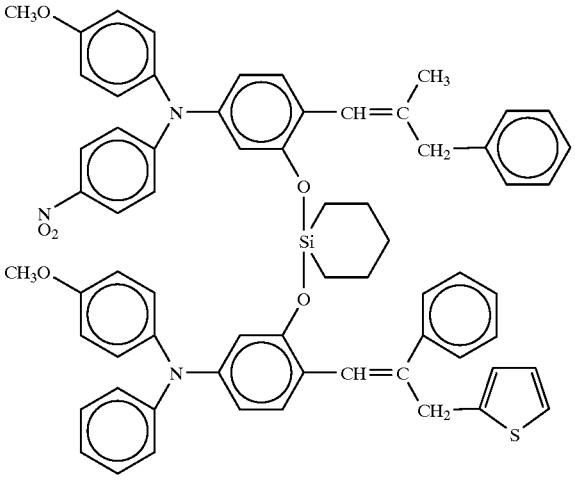
21
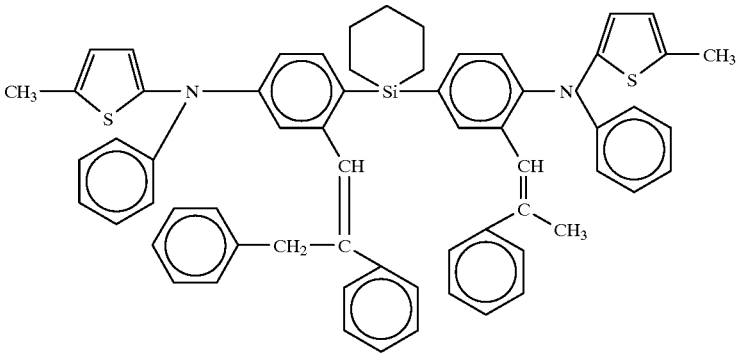
The stilbene compound represented by the above formula [I] can be produced by the known methods. For example, a desired compound can be obtained by Wittig-Hornor-Emmons reaction between a biscarbonyl compound and a phosphonic acid diester. This method is described in detail below.

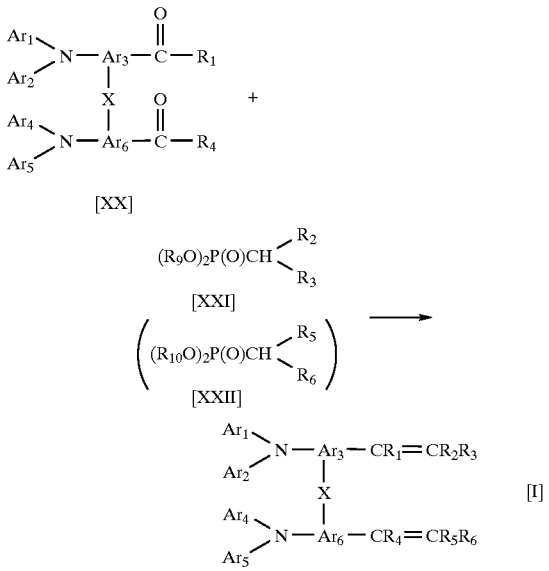

The biscarbonyl compound represented by the formula [XX], in which $Ar_1$, $Ar_2$, $Ar_3$, $Ar_4$, $Ar_5$, $Ar_6$, $R_1$, and $R_4$ have the same definition as in the formula [I], is reacted with the phosphonic acid diester represented by the formula [XXI], in which $R_2$ and $R_3$ have the same definition as in the formula [I] and $R_9$ represents an alkyl group, in a solvent such as tetrahydrofuran, 1,2-dimethoxyethane, N,N-dimethylformamide, or the like in the presence of a base such as potassium alkoxide, sodium hydride, sodium alkoxide, or the like to obtain the stilbene compound represented by the formula [I] (Wittig-Hornor-Emmons reaction).

In this occasion, an unsymmetrical stilbene compound represented by the formula [I] may be obtained by mixing two kinds of phosphonic acid diesters of XXI and XXII.

Further, either a cis-form, a trans-form, or a mixture of a cis-form and a trans-form at the two double bondings can be obtained. (The formula [I] represents a cis-form, a trans-form, or a mixture of a cis-form and a trans-form at the two double bondings.)

In these reactions, a highly purified compound may be obtained by carrying out the known purification means such as recrystallization, column purification, or the like, after completion of each step or completion of whole steps.

The electrophotographic photoreceptor of the present invention has a photosensitive layer containing one or two or more stilbene compound(s) represented by the formula [I].

The stilbene compound represented by the formula [I] has extremely excellent properties as an organic photoconductor. Particularly, it gives a highly sensitive photoreceptor having excellent durability when used as a charge-transport agent.

Various forms are known as the photosensitive layer of the electrophotographic photoreceptor. However, any of such forms can be applied to the photosensitive layer of the electrophotographic photoreceptor of the present invention. Examples of such a photosensitive layer include one containing the stilbene compound and, if necessary, a dye or an electron-accepting compound, added to a binder, one containing charge-generation particles which generate a charge carrier in high efficiency when they absorbs light and the stilbene compound added to a binder, one composed of a charge-transport layer containing the stilbene compound and a binder, which is layered with a charge-generation layer containing charge-generation particles that generate a charge carrier in high efficiency when they absorbs light and/or a binder, and the like.

In these photosensitive layers, a known arylamine, hydrazone, stilbene, or the like compound having excellent properties as an organic photoconductor may be added as well as the stilbene compound represented by the formula [I].

According to the present invention, when the stilbene compound represented by the formula [I] is used in a charge-transport layer of a photosensitive layer composed of a charge-generation layer and a charge-transport layer, the resulting photoreceptor has particularly high sensitivity, low residual potential, and has so excellent durability that change of surface potential, a decrease in sensitivity, and accumulation of residual potential are small when it is repeatedly used.

The electrophotographic photoreceptor of the present invention can be produced by dissolving the stilbene compound represented by the formula [I] and a binder in an appropriate solvent, if necessary, adding charge-generation particles that generate a charge carrier in high efficiency when they absorbs light, a sensitizing dye, an electron-accepting compound, or a plasticizer, a pigment or the other additives, to give a coating solution, which is coated on a conductive substrate and dried to form a photosensitive layer having a thickness of generally several micrometers to several tens micrometers, preferably 10 to 40 $\mu$m. In the case of the photosensitive layer composed of two layers; a charge-generation layer and a charge-transport layer, the above coating solution is coated on the charge-generation layer or the charge-generation layer is laminated on the charge-transport layer which is prepared by coating the above coating solution to produce the photosensitive layer.

The solvent used for preparing the coating solution is one that dissolves the stilbene compound, including ethers such as tetrahydrofuran, or 1,4-dioxane; ketones such as methyl ethyl ketone, or cyclohexanone; aromatic hydrocarbons such as toluene or xylene; an aprotic polar solvent such as N,N-dimethylformamide, acetonitrile, N-methylpyrrolidone, or dimethylsulfoxide; esters such as ethyl acetate, methyl formate, or methyl cellosolve acetate; chlorinated hydrocarbons such as dichloroethane or chloroform, and the like. As a matter of course, the solvent must be selected among those which dissolves a binder. The binders are exemplified by various polymers which are compatible with the stilbene compound, including a polymer or a copolymer of a vinyl compound such as styrene, vinyl acetate, vinyl chloride, acrylic acid ester, methacrylic acid ester, butadiene, or the like; polyvinyl acetal, polycarbonate, polyester, polystyrene, polyphenyleneoxide, polyurethane, cellulose ester, cellulose ether, phenoxy resin, silicon resin, epoxy resin, and the like. The binder is used in an amount ranging generally from 0.5 to 30 times by weight, preferably from 0.7 to 10 times by weight, of the weight of the stilbene compound.

Known materials can be used for charge-generation particles, a pigment, and an electron-accepting compound, which are added to the photosensitive layer. Examples of the charge-generation particles that generate a charge carrier in high efficiency when they absorbs light, include inorganic charge-generation particles such as selenium, selenium-tellurium alloy, selenium-arsenic alloy, cadmium sulfide, or amorphous silicon; organic charge-generation particles such as metal-containing phthalocyanine, perylene pigments, thioindigo, quinacridon, anthraquinone pigments, azo pigments, bisazo pigments, trisazo pigments, tetrakis azo pigments, cyanine pigments, and the like. Particularly, when a bisazo pigment is used in combination with the stilbene compound, an excellent elecroreceptor having improved sensitivity and low residual potential can be obtained.

As a coupler component of azo pigment is preferably exemplified by that represented by the following formula [IV'].

[IV']

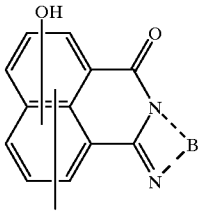

Examples of the dyes include triphenylmethane dyes such as methyl violet, brilliant green, or crystal violet; thiazine dyes such as methylene blue, quinone dyes such as quinizaline; cyanine dyes, pyrylium salts, thiapyrylium salts, benzopyrylium salts, and the like.

Examples of the electron-accepting compound which forms a charge transfer complex with the stilbene compound include quinones such as chloranil, 2,3-dichloro-1,4-naphthoquinone, 1-nitroanthraquinone, 1-chloro-5-nitroanthraquinone, or 2-chloroanthraquinone, phenanthrequinone; aldehydes such as 4-nitrobenzaldehyde; ketones such as 9-benzoylanthracene, indandione, 3,5-dihydrobenzophenone, 2,4,7-trinitrofluorenone, 2,4,5,7-tetranitrofluorenone, or 3,3',5,5'-tetranitrobenzophenone; acid anhydrides such as phthalic anhydride or 4-chloronaphthalic anhydride; cyano compounds such as tetracyanoethylene, telephthalmalononitrile, 9-antolylmethylidenemalononitrile, 4-nitrobenzalmalononitrile, or 4-(p-nitrobenzoyloxy) benzalmalononitrile; phthalides such as 3-benzalphthalide, 3-(α-cyano-p-nitrobenzal)phthalide, or 3-(α-cyano-p-nitrobenzal)-4,5,6,7-tetrachlorophthalide, and the like.

The photosensitive layer of the electrophotographic photoreceptor of the present invention may further contain a known plasticizer to improve its film-forming property, flexibility, and mechanical strength. For this purpose, the plasticizer to be added to the above coating solution includes aromatic compounds such as phthalic acid ester, phosphoric acid ester, epoxy-compounds, chlorinated paraffin, chlorinated aliphatic acid ester, or aromatic compounds such as methylnaphthalene, and the like. In the case of using the stilbene compound as the charge-transport agent in the charge transferring layer, the coating solution may have the above-described composition, or exclude the charge-generation particles, the dye, the electron-accepting compound, and the like, or contains these substances in a small amount. In this case, the charge-generation layer is exemplified by a thin layer obtained by coating a coating solution prepared by dissolving or dispersing in a solvent the above charge-generation particles and, if necessary, a binder polymer, an organic photoconductive substance, a dye, an electron-accepting compound, or the like followed by drying, or a film layer formed by means of, for example, evaporation of the above charge-generation particles.

The photosensitive layer of the elecrophotographic photoreceptor of the present invention may contain the known additives to improve electrical characteristics or durability against repeated use. The additives to be added to the above coating solution for this purpose include phenol compounds, organic phosphorus-containing compounds, organic sulfur-containing compounds, and the like.

As a matter of course, the photoreceptor thus obtained may contain an adhesive layer, an intermediate layer, a transparent insulating layer, and the like, if required.

Any conductive substrate, on which the photosensitive layer is formed, used for the known electrophotographic photoreceptor can be used. Specific examples thereof include a metal drum, sheets of aluminum, stainless steel or copper, or laminated and evaporated products of a metal film of these materials. Alternatively, usable are a plastic film, a plastic drum, paper, a paper tube, and the like which are prepared by coating a conductive substance such as metal powder, carbon black, copper iodide, high molecular electrolytes, and the like, together with an appropriate binder followed by conduction treatment. Further exemplified are plastic sheets or drum containing metal powder, carbon black, carbon fiber, and the like conductive substances to have conductivity.

The electrophotographic photoreceptor of the present invention has remarkably high sensitivity and its residual potential that causes fogged image is small. Particularly, because of its low fatigue by light, low accumulation of residual potential and small change of surface potential and sensitivity attributed to repeated use and strong exposure make its durability excellent. Thus, the photoreceptor suits for not only PPC use but also use for the photoreceptor of printing machines such as laser printers, liquid crystal shutter printers, LED printers, and the like, which particularly require stable performance and reliability.

DETAILED DESCRIPTION OF THE PREFERRED EMBODIMENTS

The present invention will be further concretely illustrated by the following examples, but is not construed to be limited to the following production examples and examples unless they beyond the subject matter of the present invention. In the following examples, "part(s)" means "part(s) by weight".

PRODUCTION EXAMPLE 1

A bisaldehyde compound (5.8 g) represented by the formula:

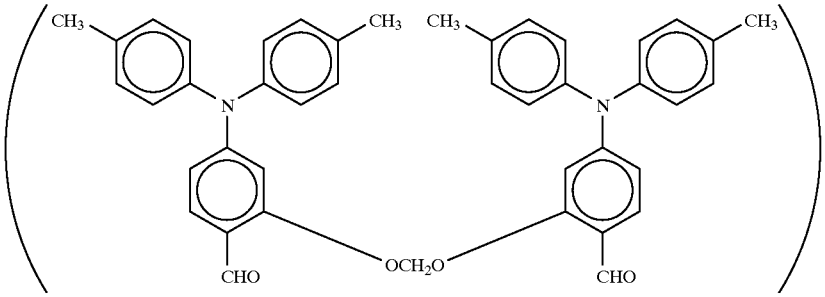

and phosphonic acid diester (8.9 g) represented by the formula:

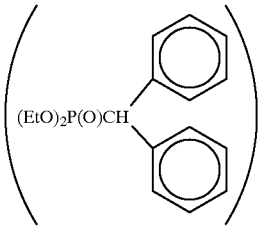

were dissolved in 120 ml of tetrahydrofuran and 3.0 g of potassium t-butoxide was further added thereto at 10° C. or lower. After stirring the resulting reaction mixture at room temperature for 45 minutes, 100 ml of water was added to the mixture followed by extraction, concentration, and purification by the conventional method to obtain 3.7 g of pale yellow crystals (melting point: 113–115° C.).

The thus-obtained compound was confirmed to be a stilbene compound (Demonstrative Compound No. 2) having the following structural formula by measuring its mass spectrum and infrared absorption spectrum (FIG. 1). Mass spectrum data: MW=946, $M^+$=946, as $C_{69}H_{58}O_2N_2$.

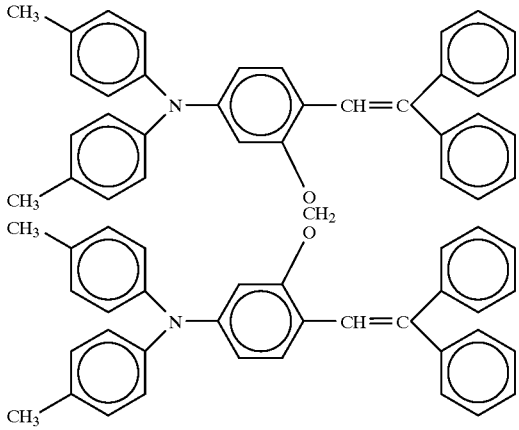

PRODUCTION EXAMPLE 2

The bisaldehyde compound (5.8 g) represented by the formula:

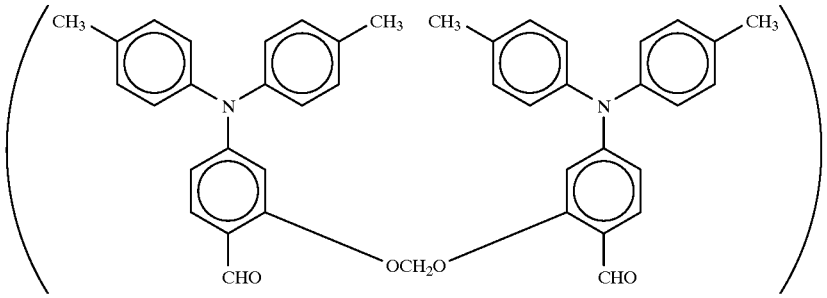

as used in Production Example 1 was reacted with phosphonic acid diester ($(EtO)_2P(O)CH_2Ph$) (6.1 g) in the same manner as in Production Example 1 to obtain 3.4 g of pale yellow crystals (melting point: 102–103° C.).

Figure 2:
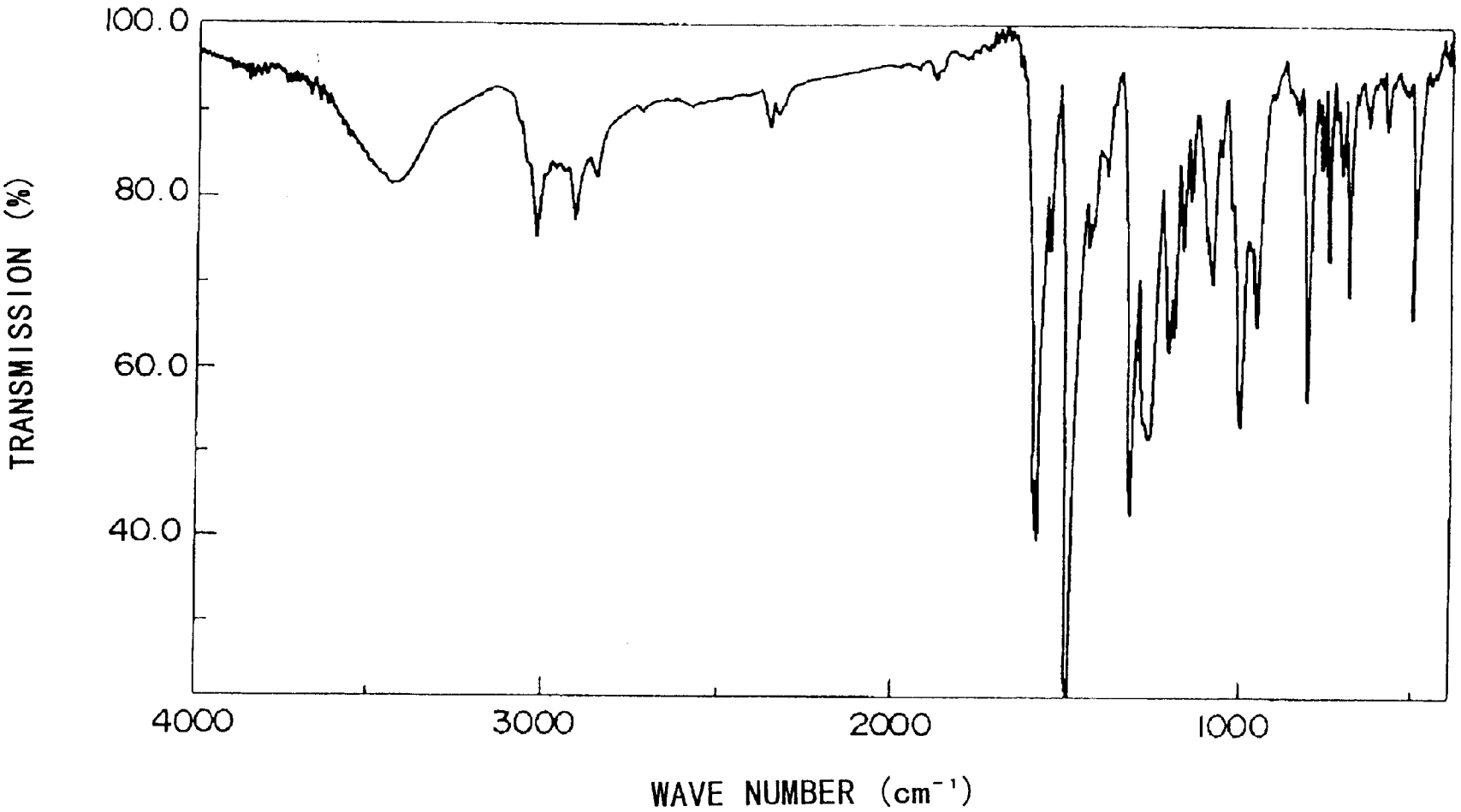
FIG. 2 shows infrared absorption spectrum of the stilbene compound produced in Production Example 2.

The thus-obtained compound was confirmed to be a stilbene compound (Demonstrative Compound No. 1) having the following structural formula by measuring its mass spectrum and infrared absorption spectrum (FIG. 2). Mass spectrum data: MW=794, M+=794, as $C_{57}H_{50}O_2N_2$.

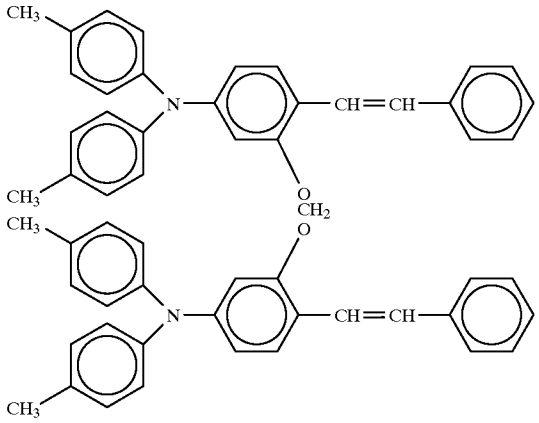

EXAMPLE 1

One part of naphthalic acid bisazo pigment represented by the formula:

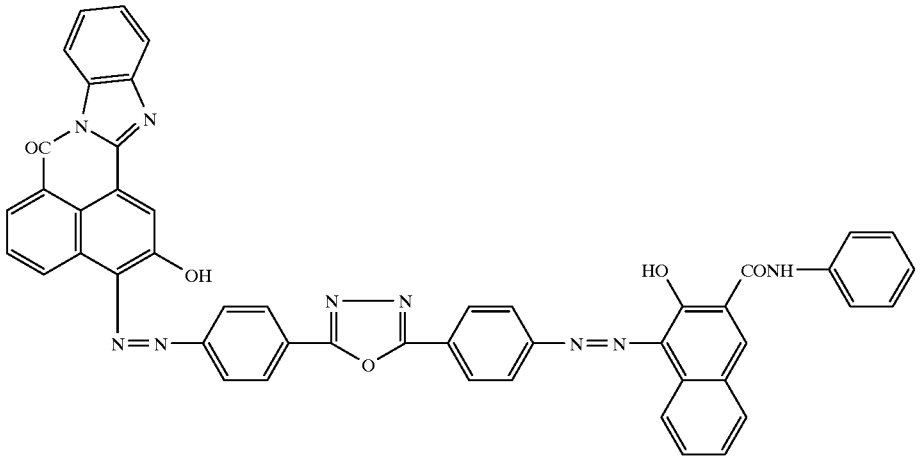

was added to 14 parts of dimethoxyethane followed by dispersing using a sand grinder. Then, the dispersion was diluted by adding 14 parts of dimethoxyethane and 14 parts of 4-methoxy-4-methyl-2-pentanone (Mitsubishi Chemical Corporation) and mixed with a solution prepared by dissolving 0.5 part of polyvinyl butyral (Denki Kagaku Kogyo, trade name: DENKABUTYRAL #6000-C) and 0.5 part of phenoxy resin (Union Carbide, trade name: UCAR™PKHH) in a mixture of 6 parts of dimethoxyethane and 6 parts of 4-methoxy-4-methyl-2-pentanone. The resulting dispersion was coated by a wire bar on an aluminum-deposited polyester film having a thickness of 75 $\mu$m so as to give a weight after drying of 0.2 g/m$^2$. The coated film was dried to form a charge-generation layer.

On this layer a coating solution prepared by dissolving 110 parts of the stilbene compound (Demonstrative Compound No. 2) produced in Production Example 1 and 100 parts of polycarbonate resin represented by the formula:

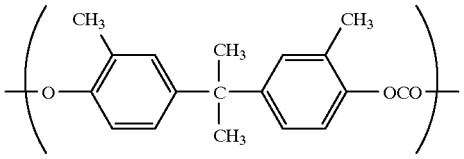

in 900 parts of tetrahydrofuran was coated and then dried to form a charge-transport layer having a thickness of 28 $\mu$m.

The thus-obtained electrophotographic photoreceptor having the photosensitive layer composed of the two layers was measured for sensitivity, that is, half light exposure, which was 0.47 lux·sec.

The half light exposure was determined by allowing the photoreceptor to be negatively charged by 22 $\mu$A of corona charge in the dark, exposing it to 1 lux of white light, and measuring light exposure required for reducing the surface potential from −450 V to −225 V. The surface potential when the exposure time was 9.9 seconds was measured as residual potential, which was −2 V.

EXAMPLE 2

The electrophotographic photoreceptor was produced in the same manner as in Example 1 except for using oxytitanium phthalocyanine pigment which shows main peaks at 9.3°, 13.20°, 26.2°, and 27.1° of Bragg angle (2θ±0.2°) in X-ray diffraction spectrum in place of the naphthalic acid bisazo pigment used in Example 1, 70 parts of the stilbene compound, and a charge-transport layer having a thickness of 20 $\mu$m. The resulting photoreceptor was exposed to light at 780 nm (quantity of light: 500 nW) to measure the half light exposure, which was 0.48 $\mu$J/cm$^2$. The residual potential was −7 V.

EXAMPLE 3

The electrophotographic photoreceptor was produced in the same manner as in Example 2 except for using the stilbene compound (Demonstrative Compound No. 1) synthesized in Production Example 2 in place of the stilbene compound used in Example 1 to measure its half light exposure, which was 0.44 lux·sec. The residual potential was −3 V.

EXAMPLE 4

The electrophotographic photorecproduceas produced in the same manner as in Example 2 except for using the stilbene compound synthesized in Production Example 2 in place of the stilbene compound used in Example 1 to measure its half light exposure, which was 0.45 $\mu J/cm^2$. The residual potential was −7 V.

What is claimed is:

1. An electrophotographic photoreceptor having a photosensitive layer on the conductive substrate, wherein said photosensitive layer comprises a stilbene compound represented by the formula [I]:

[I]

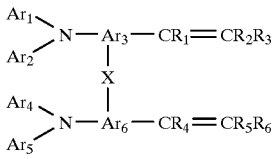

wherein $Ar_1$, $Ar_2$, $Ar_4$, and $Ar_5$ each represent a substituted or unsubstituted alkyl group, a substituted or unsubstituted aryl group, a substituted or unsubstituted aralkyl group, a substituted or unsubstituted heterocyclic group, or a substituted or unsubstituted condensed polycyclic group and these may be the same or different;

$Ar_3$ and $Ar_6$ each represent a substituted or unsubstituted trivalent aromatic hydrocarbon ring group, a substituted or unsubstituted trivalent heterocyclic group, a substituted or unsubstituted trivalent condensed polycyclic group, or a substituted or unsubstituted trivalent biphenyl group, and these may be the same or different;

$R_1$, $R_2$, $R_3$, $R_4$, $R_5$, and $R_6$ each represent a hydrogen atom, a substituted or unsubstituted alkyl group, a substituted or unsubstituted aralkyl group, a substituted or unsubstituted aryl group, a substituted or unsubstituted heterocyclic group, or a substituted or unsubstituted condensed polycyclic group, and these may be the same or different, provided that when one of a couple of $R_2$ and $R_3$ represents a hydrogen atom, a substituted or unsubstituted alkyl group, or a substituted or unsubstituted aralkyl group, the other represents a substituted or unsubstituted aryl group, a substituted or unsubstituted heterocyclic group, or a substituted or unsubstituted condensed polycyclic group, and when one of a couple of $R_5$ and $R_6$, represents a hydrogen atom, a substituted or unsubstituted alkyl group, or a substituted or unsubstituted aralkyl group, the other represents a substituted or unsubstituted aryl group, a substituted or unsubstituted heterocyclic group, or a substituted or unsubstituted condensed polycyclic group, provided that the substituent of $R_2$, $R_3$, $R_5$, and $R_6$, is not a di-substituted amino group; and X represents a substituted or unsubstituted alkenylene group, a substituted or unsubstituted arylene group, or a substituted or unsubstituted divalent heterocyclic group, or the groups represented by any of the formulae [II] to [V]:

[II]

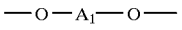

[III]

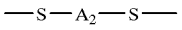

[IV]

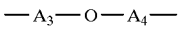

[V]

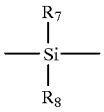

wherein $A_1$, $A_2$, $A_3$, and $A_4$ each represent a substituted or unsubstituted alkylene group, a substituted or unsubstituted alkenylene group, or the formula [V], wherein $R_7$ and $R_8$ each represent a substituted or unsubstituted alkyl group, a substituted or unsubstituted aralkyl group, a substituted or unsubstituted aryl group, a substituted or unsubstituted heterocyclic group, a substituted or unsubstituted condensed polycyclic group and these may be the same or different, or $R_7$ and $R_8$ may combine to form a substituted or unsubstituted cycloalkyl group; $Ar_1$ and $Ar_2$, $Ar_2$ and $Ar_3$, $Ar_1$ and $Ar_3$, $Ar_4$ and $Ar_5$, $Ar_5$ and $Ar_6$, $Ar_4$ and $Ar_6$, $R_2$ and $R_3$, and $R_5$ and $R_6$ may link directly or via a divalent group.

2. The electrophotographic photoreceptor according to claim 1, wherein, in the formula [I], X is represented by the formula [II] or [III].

3. The electrophotographic photoreceptor according to claim 1 or 2, wherein said photosensitive layer contains a charge-generation agent and a charge-transport agent and the stilbene compound represented by the formula [I] is used as the charge-transport agent.

4. The electrophotographic photoreceptor according to claim 3, wherein said photosensitive layer contains at least a charge-transport layer containing the charge-transport agent and a charge-generation layer containing the charge-generation agent and a binder resin, and the stilbene compound represented by the formula [I] is used as the charge-transport agent in the charge-transport layer.

5. The electrophotographic photoreceptor according to claim 4, wherein said charge-transport layer contains a charge-transport agent and a binder resin.

6. The electrophotographic photoreceptor according to claim 3, wherein the charge-generation agent is an azo pigment which has in the molecule a coupler component represented by the formula [IV']:

[IV']

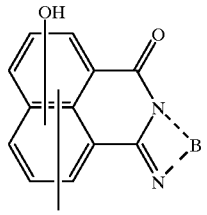

wherein B is a substituted or unsubstituted divalent nitrogen-containing heterocyclic group or a substituted or unsubstituted divalent aromatic hydrocarbon group.

* * * * *